US011315722B2

(12) United States Patent
Xu et al.

(10) Patent No.: US 11,315,722 B2
(45) Date of Patent: Apr. 26, 2022

(54) LOW-VOLTAGE LEAD STRUCTURE FOR THREE-DIMENSIONAL WOUND CORE OF TRANSFORMER

(71) Applicant: HAIHONG ELECTRIC CO., LTD., Kaiping (CN)

(72) Inventors: Kaixuan Xu, Kaiping (CN); Lizhen Zhai, Kaiping (CN); Qingning Liang, Kaiping (CN); Jingtao Luo, Kaiping (CN); Libo Zhou, Kaiping (CN)

(73) Assignee: HAIHONG ELECTRIC CO., LTD., Kaiping (CN)

( * ) Notice: Subject to any disclaimer, the term of this patent is extended or adjusted under 35 U.S.C. 154(b) by 440 days.

(21) Appl. No.: 16/439,320

(22) Filed: Jun. 12, 2019

(65) Prior Publication Data

US 2019/0295766 A1 Sep. 26, 2019

Related U.S. Application Data

(63) Continuation of application No. PCT/CN2017/112733, filed on Nov. 24, 2017.

(30) Foreign Application Priority Data

Apr. 1, 2017 (CN) ..... 201720347268.1

(51) Int. Cl.
*H01F 27/29* (2006.01)
*H01F 27/26* (2006.01)
*H01F 27/32* (2006.01)

(52) U.S. Cl.
CPC ..... *H01F 27/29* (2013.01); *H01F 27/263* (2013.01); *H01F 27/32* (2013.01)

(58) Field of Classification Search
CPC ..... H01F 27/29; H01F 27/263; H01F 27/32; H01F 27/25; H01F 30/12; H01F 38/38; H01F 27/02; H01F 27/04
See application file for complete search history.

(56) References Cited

U.S. PATENT DOCUMENTS 4,588,971 A * 5/1986 Beisser ..... H01F 27/306 336/150
2012/0139678 A1* 6/2012 Outten ..... H01F 41/08 336/5

(Continued)

FOREIGN PATENT DOCUMENTS

CN 201259817 Y 6/2009
CN 201868202 U 6/2011

(Continued)

OTHER PUBLICATIONS

International Search Report issued by the State Intellectual Property Office of the P R China for corresponding International Patent Application No. PCT/CN2017/112733, dated Feb. 26, 2018, with an English translation.

*Primary Examiner* — Mang Tin Bik Lian
(74) *Attorney, Agent, or Firm* — Myers Wolin, LLC

(57) ABSTRACT

A transformer three-dimensional wound core low-voltage lead structure is provided comprising a three-dimensional wound core formed of three rectangular single frames, and three phase windings. The wound core comprises three core posts and an yoke, the yoke being a triangular structure. The three phase windings are arranged on the three core posts, each phase winding comprising an internal low-voltage and high-voltage winding. The head end and the tail end of each phase low-voltage winding are respectively connected to a lead-out line, and the lead-out lines are located in a triangular structure region of the yoke, and a low-voltage bushing step-up module is provided above the wound core, three low-voltage bushings are provided on the low-voltage bushing step-up module, and the three low-voltage bushings are connected to the lead-out line of the corresponding low-voltage winding.

4 Claims, 1 Drawing Sheet

(56) References Cited

U.S. PATENT DOCUMENTS

| | | | | |
|---|---|---|---|---|
| 2013/0106546 | A1* | 5/2013 | Outten | H01F 30/12 336/5 |
| 2013/0162381 | A1* | 6/2013 | Xu | H01F 27/008 336/58 |
| 2013/0200967 | A1* | 8/2013 | Xu | H01F 17/0013 336/5 |
| 2015/0016060 | A1* | 1/2015 | Outten | H01F 27/2823 361/695 |
| 2015/0084732 | A1* | 3/2015 | Lim | H01F 41/06 336/213 |
| 2015/0235752 | A1* | 8/2015 | Stryken | H01F 41/0233 336/5 |
| 2016/0055970 | A1* | 2/2016 | Xu | H01F 5/04 29/605 |

FOREIGN PATENT DOCUMENTS

| | | | |
|---|---|---|---|
| CN | 202258680 | U | 5/2012 |
| CN | 102543388 | A | 7/2012 |
| CN | 202230845 | U | 5/2013 |
| CN | 203312013 | U | 11/2013 |
| CN | 203733590 | U | 7/2014 |
| CN | 206672769 | U | 11/2017 |
| JP | 4977563 | B2 | 7/2012 |
| WO | 2014/098272 | A1 | 6/2014 |

* cited by examiner

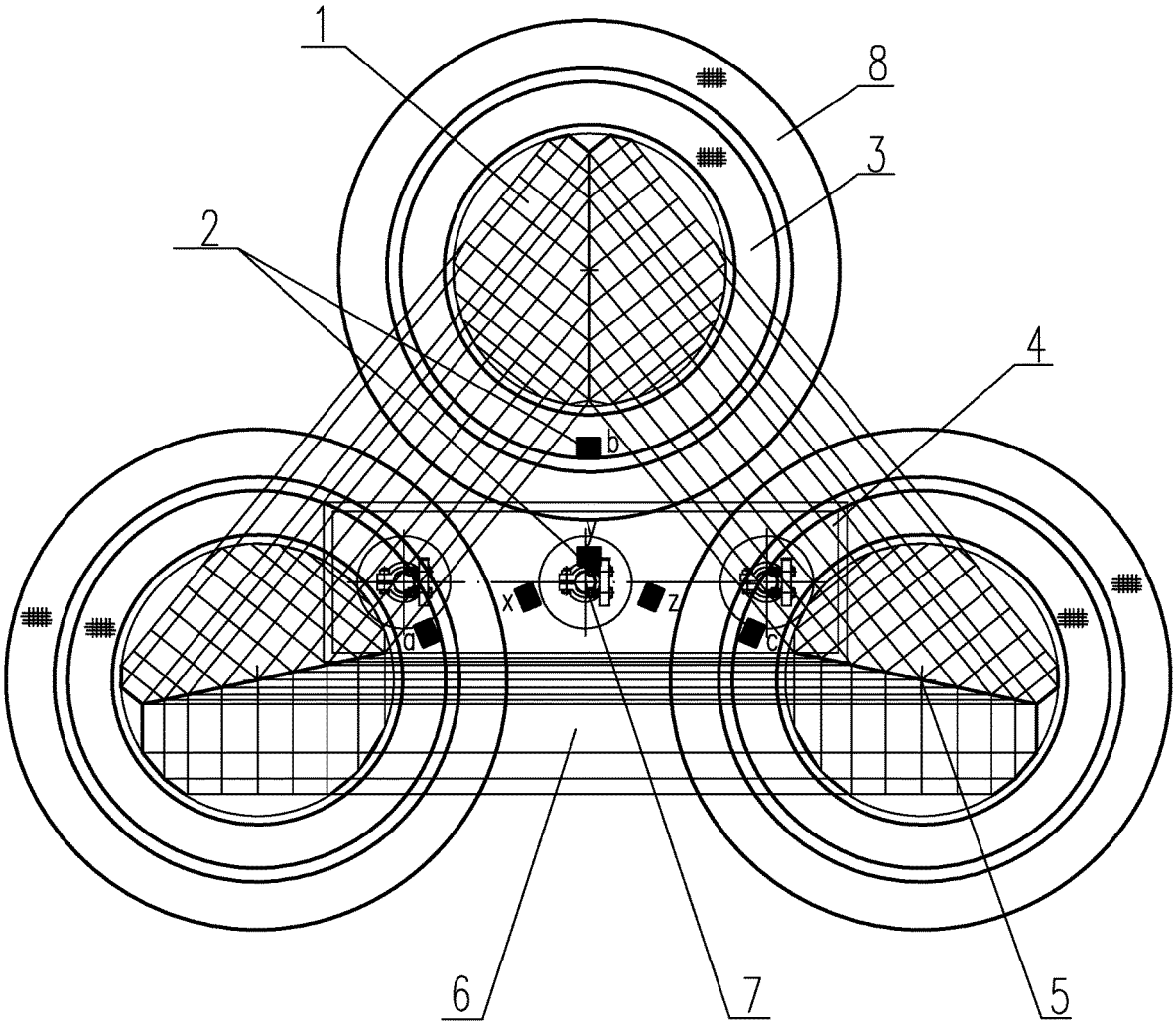
1
8
3
2
4
b
y
x
z
a
c
6
7
5

LOW-VOLTAGE LEAD STRUCTURE FOR THREE-DIMENSIONAL WOUND CORE OF TRANSFORMER

CROSS REFERENCE TO RELATED APPLICATIONS

This application is a continuation of International Application No. PCT/CN2017/112733, filed on Nov. 24, 2017, which takes priority from Chinese Patent Application No. 201720347268.1, filed on Apr. 1, 2017, the contents of each of which are incorporated by reference herein.

TECHNICAL FIELD

The disclosure relates to the field of transformer technology, and more particularly, to a low-voltage lead structure for a three-dimensional wound core of a transformer.

BACKGROUND

At present, a transformer product with a three-dimensional wound core has been favored by more and more customers, and the advantages of high efficiency and energy saving thereof have long been known by people, and the market share is increasing. However, low-voltage lead output ports of three-phase windings of a traditional transformer product with a three-dimensional wound core are all led outside the body of the transformer. In order to couple the three-phase low-voltage leads into different connection groups, the lead of one phase or two phases must bypass other windings, which increases a length of the lead and a wiring difficulty, and takes up a large space, thus virtually increasing a manufacturing difficulty and material cost of the transformer. It often causes a problem that an unevenness rate of phase and lead resistance exceeds a standard due to different lengths of the leads of each phase.

SUMMARY

The disclosure is intended to provide a low-voltage lead structure for a three-dimensional wound core of a transformer, so as to solve problems of unbalanced resistance and excessive losses of leads caused by different lengths of the leads of each phase, etc.

In the disclosure, the technical solutions for solving the technical problems are as follows.

A novel low-voltage lead structure for a three-dimensional wound core of a transformer includes a three-dimensional wound core spliced by three rectangular single frames and three-phase windings. The three-dimensional wound core includes three core legs, and an iron yoke, the iron yoke of the three-dimensional wound core is a triangular structure. The three-phase windings are correspondingly arranged in the three core legs. Each single-phase winding includes an internal low-voltage winding and an external high-voltage winding. A head end and a tail end of each single-phase low-voltage winding are respectively connected to a lead-out wire; and the lead-out wires of the head end and the tail end of each single-phase low-voltage winding are located in triangular structure regions of the iron yoke. A low-voltage bushing ascending base is arranged in the three-dimensional wound core. Three low-voltage bushings are arranged in the low-voltage bushing ascending base, and connected to the corresponding lead-out wires of the low-voltage windings.

Further, the low-voltage bushing ascending base is located in the triangular structure region of the iron yoke.

Further, the three low-voltage bushings are arranged along a straight line.

Further, the lead-out wires at the head ends of the three-phase low-voltage windings and the lead-out wires at the tail ends of the three-phase low-voltage windings are respectively of triangle arrangement.

Further, the lead-out wires at the head ends of the three-phase low-voltage windings are arranged at three corner positions formed by the iron yoke; and the lead-out wires at the tail ends of the three-phase low-voltage windings are arranged inside the three-phase windings.

The disclosure has the beneficial effects that: according to the disclosure, by adjusting a position of the lead-out wire of the low-voltage winding and an insulation structure of the lead, a head and a tail of the lead-out wire of the low-voltage winding are concentrated in the triangular regions of the iron yoke of the core, so that various connections between the head and the tail of each winding are convenient, and the low-voltage bushing ascending base is also designed in the triangular region of the yoke of the core, a distance between the lead and the bushing is very short, and the lead is fixed only by using few clamping pieces or directly connected to a bushing conducting rod. In addition, lengths of the leads of each phase are very close, a resistance unevenness caused by different lengths of the leads will be completely solved, and meanwhile, transformer accidents caused by lead faults are greatly reduced, and a reliability of the product is increased.

BRIEF DESCRIPTION OF THE DRAWINGS

FIG. 1 is an exemplary structure diagram according to the disclosure.

DETAILED DESCRIPTION

The disclosure is further described below with reference to the drawing and the embodiments.

As shown in FIG. 1, a novel low-voltage lead structure for a three-dimensional wound core of a transformer according to the disclosure includes a three-dimensional wound core 1 spliced by three rectangular single frames, and three-phase windings, wherein the three-dimensional wound core 1 includes three core legs 5, and an iron yoke 6. The iron yoke 6 of the three-dimensional wound core is a triangular structure. The three-phase windings are correspondingly arranged in the three core legs 5, wherein each single-phase winding includes an internal low-voltage winding 3 and an external high-voltage winding 8. A head end and a tail end of each single-phase low-voltage winding 3 are respectively connected to a lead-out wire 2; and the lead-out wires 2 of the head end and the tail end of each single-phase low-voltage winding 3 are located in triangular structure regions of the iron yoke 6. A low-voltage bushing ascending base 4 is arranged in the three-dimensional wound core 1. Three low-voltage bushings 7 are arranged in the low-voltage bushing ascending base 4, and connected to the corresponding lead-out wires 2 of the low-voltage windings.

The low-voltage bushing ascending base 4 is located in the triangular structure region of the iron yoke 6, in which three low-voltage bushings 7 are arranged along a straight line.

The lead-out wires (a, b and c) at the head ends of the three-phase low-voltage windings 3 and the lead-out wires (x, y and z) at the tail ends of the three-phase low-voltage windings 3 are respectively of triangle arrangement.

The lead-out wires (a, b and c) at the head ends of the three-phase low-voltage windings 3 are arranged at three corner positions formed by the iron yoke 6. The lead-out wires (x, y and z) at the tail ends of the three-phase low-voltage windings 3 are arranged inside the three-phase windings.

It should be appreciated that, the description above does not limit the disclosure, and the disclosure is not limited to the embodiments above. Any variations, modifications, additions or substitutions made by those skilled in the art within a substantial scope of the disclosure shall also fall within the protection scope for the disclosure.

What is claimed is:

1. A novel low-voltage lead structure for a three-dimensional wound core of a transformer, comprising:

three-phase windings, and a three-dimensional wound core (1) spliced by three rectangular single frames and comprising three core legs (5) and an iron yoke (6), wherein the iron yoke (6) of the three-dimensional wound core is a triangular structure;

the three-phase windings are correspondingly arranged in the three core legs (5);

each single-phase winding has an internal low-voltage winding (3) and an external high-voltage winding (8);

a head end and a tail end of each single-phase low-voltage winding (3) are respectively connected to a lead-out wire (2);

and the lead-out wires (2) of the head end and the tail end of each single-phase low-voltage winding (3) are located in triangular structure regions of the iron yoke (6);

a low-voltage bushing ascending base (4) is arranged in the three-dimensional wound core (1);

three low-voltage bushings (7) are arranged in the low-voltage bushing ascending base (4);

the three low-voltage bushings (7) are connected to the corresponding lead-out wires (2) of the low-voltage windings; and the low-voltage bushing ascending base (4) is located in the triangular structure region of the iron yoke (6).

2. The novel low-voltage lead structure for a three-dimensional wound core of a transformer of claim 1, wherein the three low-voltage bushings (7) are arranged along a straight line.

3. The novel low-voltage lead structure for a three-dimensional wound core of a transformer of claim 1, wherein the lead-out wires at the head ends of the three-phase low-voltage windings (3) and the lead-out wires at the tail ends of the three-phase low-voltage windings (3) are respectively of triangle arrangement.

4. The novel low voltage lead structure for a three-dimensional wound core of a transformer of claim 1, wherein the lead-out wires at the head ends of the three-phase low-voltage windings (3) are arranged at three corner positions formed by the iron yoke (6), and wherein the lead-out wires at the tail ends of the three-phase low-voltage windings (3) are arranged inside the three-phase windings.

* * * * *